US011319973B2

(12) United States Patent
Aki et al.

(10) Patent No.: US 11,319,973 B2
(45) Date of Patent: May 3, 2022

(54) ABNORMALITY DETECTING SYSTEM AND ABNORMALITY DETECTING METHOD

(71) Applicant: SMC CORPORATION, Tokyo (JP)

(72) Inventors: Tomohiko Aki, Nagareyama (JP); Norimasa Ozaki, Moriya (JP)

(73) Assignee: SMC CORPORATION, Tokyo (JP)

( * ) Notice: Subject to any disclaimer, the term of this patent is extended or adjusted under 35 U.S.C. 154(b) by 0 days.

(21) Appl. No.: 17/034,829

(22) Filed: Sep. 28, 2020

(65) Prior Publication Data

US 2021/0102561 A1 Apr. 8, 2021

(30) Foreign Application Priority Data

Oct. 3, 2019 (JP) ..... JP2019-182668

(51) Int. Cl.
*F15B 19/00* (2006.01)
*F15B 15/28* (2006.01)
*F15B 15/20* (2006.01)

(52) U.S. Cl.
CPC ..... *F15B 19/005* (2013.01); *F15B 15/204* (2013.01); *F15B 15/2815* (2013.01); *F15B 2211/30525* (2013.01); *F15B 2211/857* (2013.01); *F15B 2211/87* (2013.01)

(58) Field of Classification Search
None
See application file for complete search history.

(56) References Cited

U.S. PATENT DOCUMENTS 7,620,522 B2 * 11/2009 Bredau ..... F15B 19/005 702/113
7,970,583 B2 * 6/2011 Novis ..... F15B 19/005 702/183
9,891,135 B2 2/2018 Aki
10,119,836 B2 * 11/2018 Aki ..... F15B 19/005
10,480,549 B2 * 11/2019 Fujiwara ..... F15B 15/14
10,634,172 B2 * 4/2020 Fujiwara ..... F15B 19/005
2015/0007713 A1 1/2015 Aki
2018/0292025 A1 10/2018 Zola

FOREIGN PATENT DOCUMENTS

JP 2004-11722 A 1/2004
JP 2005-186822 A 7/2005
JP 2007-10106 A 1/2007
JP 2015-14990 A 1/2015
JP 6011875 B2 10/2016
KR 10-2018-0135967 A 12/2018

OTHER PUBLICATIONS

Extended European Search Report dated Mar. 1, 2021 in European Patent Application No. 20198908.4, 8 pages.
Korean Office Action dated Nov. 24, 2021 in Korean Patent Application No. 10-2020-0125878 (with English translation), 9 pages.

* cited by examiner

*Primary Examiner* — Michael Leslie

(74) *Attorney, Agent, or Firm* — Oblon, McClelland, Maier & Neustadt, L.L.P.

(57) ABSTRACT

An abnormality detecting system and an abnormality detecting method acquires a stroke of a piston as input from outside, calculates a travel time of the piston based on the results of sensing obtained by a first sensor and a second sensor, calculates a total travel distance of the piston using the number of operations and the stroke of the piston, and detects an abnormality of the actuator based on the travel time and the number of operations or the total travel distance of the piston.

8 Claims, 4 Drawing Sheets

ABNORMALITY DETECTING SYSTEM AND ABNORMALITY DETECTING METHOD

CROSS-REFERENCE TO RELATED APPLICATION

This application is based upon and claims the benefit of priority from Japanese Patent Application No. 2019-182668 filed on Oct. 3, 2019, the contents of which are incorporated herein by reference.

BACKGROUND OF THE INVENTION

Field of the Invention

The present invention relates to an abnormality detecting system and an abnormality detecting method for detecting an abnormality of an actuator based on a travel time of a movable portion that is displaced between one end and another end of the actuator.

Description of the Related Art

Conventionally, with an actuator having a movable portion traveling between one end and another end thereof, whether the actuator has an abnormality including a fault etc. is detected based on the leakage of working fluid (pressurized fluid) supplied to the one end or another end of the actuator, the lowest pressure (lowest working pressure) for operation of the movable portion, the takt time for the actuator, and so on.

Among these factors, the leakage of the pressurized fluid is examined, for example based on the results of detection obtained by a flow sensor that detects the flow rate of the pressurized fluid. However, with this inspection method, the results of detection obtained by the flow sensor varies depending on conditions of the tubes that supply the pressurized fluid, the pressure value of the pressurized fluid being used, the pulsation of the pressurized fluid, and temperature condition. It is therefore difficult to set such conditions.

In addition, the lowest working pressure is examined, for example based on the results of detection obtained by a pressure sensor that detects the pressure of the pressurized fluid. However, this inspection method requires checking the lowest working pressure with the actuator being at rest. Further, the travel rate of the movable portion varies depending on the bore size of the actuator's cylinder and the stroke of the movable portion. It is difficult to set these conditions also in this case.

Accordingly, Japanese Patent No. 6011875 discloses a technique in which an abnormality detecting device provided on the actuator side performs a process of detecting an abnormality of the takt time of the actuator using statistical data stored in the device, and the detected result is outputted to outside.

SUMMARY OF THE INVENTION

However, in the technique of the prior art above, performing the abnormality detecting process requires determining settings like a threshold of the initial value of the takt time etc. according to individual devices and conditions under which they are used.

The present invention has been devised considering these problems, and an object of the present invention is to provide an abnormality detecting system and an abnormality detecting method that can detect an abnormality such as a fault etc. of at least the actuator easily, at low cost, accurately, and speedily.

Aspects of the present invention are directed to an abnormality detecting system and an abnormality detecting method for detecting an abnormality of an actuator based on a travel time of a movable portion that is displaced between one end and another end of the actuator.

The abnormality detecting system includes: a first sensor that senses the movable portion that has been displaced to the one end; a second sensor that senses the movable portion that has been displaced to another end; an external input unit that inputs a stroke of the movable portion; a travel time calculating unit that calculates the travel time based on the results of sensing obtained by the first sensor and the second sensor; a travel distance calculating unit that calculates a total travel distance of the movable portion based on the number of operations of the movable portion and the stroke; and an abnormality detecting unit that detects an abnormality of at least the actuator based on the travel time and the number of operations or the total travel distance.

The abnormality detecting method includes: a first step of inputting a stroke of the movable portion by means of an external input unit; a second step of sensing by means of a first sensor the movable portion that has been displaced to the one end, and sensing by means of a second sensor the movable portion that has been displaced to another end; a third step of calculating, by means of a travel time calculating unit, the travel time based on the results of sensing obtained by the first sensor and the second sensor; a fourth step of calculating, by means of a travel distance calculating unit, a total travel distance of the movable portion based on the number of operations and the stroke of the movable portion; and a fifth step of detecting, by means of an abnormality detecting unit, an abnormality of at least the actuator based on the travel time and either the number of operations or the total travel distance.

According to the present invention, the stroke of the movable portion is entered as input from outside and an abnormality of the actuator is detected on the basis of the input stroke, the results of sensing obtained by the first sensor and the second sensor, and the number of operations of the movable portion. Accordingly, it is possible to detect an abnormality of the actuator more easily, at lower cost, more accurately, and more speedily, as compared to the technique of the patent publication cited above which detects an abnormality of the actuator using statistical data stored in the device.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Figure 1:
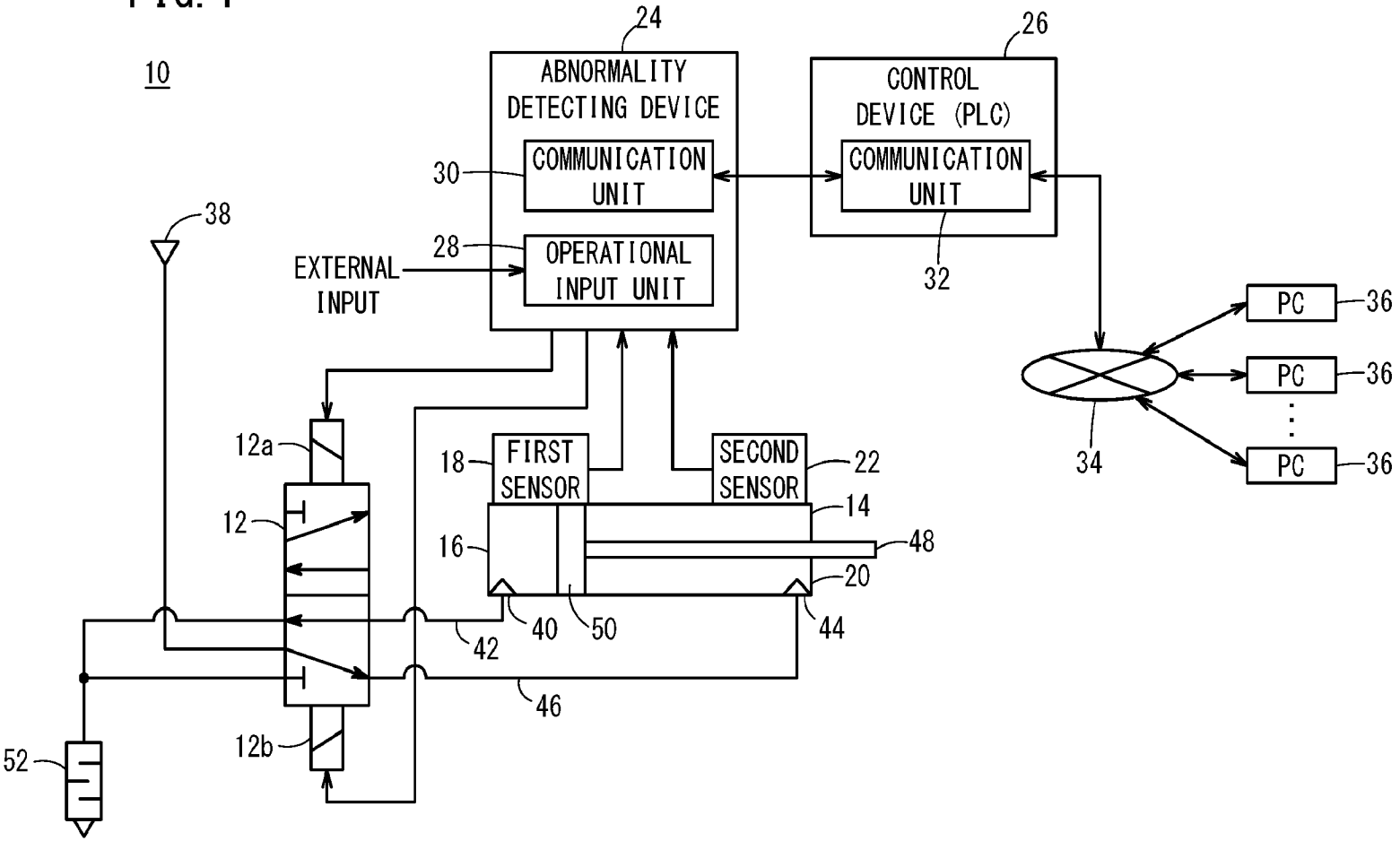
FIG. 1 is a configuration diagram illustrating an abnormality detecting system according to an embodiment.

The abnormality detecting system and abnormality detecting method according to the present invention will be described while referring to the drawings in connection with illustrative preferred embodiments.

1. Configuration of Embodiment

<1.1. Overall Configuration of Abnormality Detecting System 10>

As shown in FIG. 1, an abnormality detecting system 10 of this embodiment includes a directional control valve 12 being a 4-direction 5-port double-acting solenoid valve, an actuator 14 such as a fluid pressure cylinder etc., a first sensor 18 (first sensor) disposed at one end 16 of the actuator 14, a second sensor 22 (second sensor) disposed at another end 20 of the actuator 14, an abnormality detecting device 24, and a control device 26 (another device) such as a PLC (Programmable Logic Controller) etc.

The abnormality detecting system 10 is a system that is incorporated in equipment not shown, and it has an abnormality detecting function of automatically detecting, without stopping the equipment, abnormalities, such as degradation, faults, etc., of the actuator 14 while the equipment is in operation. In this embodiment, "one end 16" of the actuator 14 indicates the left-hand (head-side) end of the fluid pressure cylinder in FIG. 1, and "another end 20" indicates the right-hand (rod-side) end of the fluid pressure cylinder.

The abnormality detecting device 24 is situated in the vicinity of the actuator 14 of the equipment and includes an operation and input unit 28 (external input unit) that allows entry of various information from outside, and a communication unit 30. The operation and input unit 28 is an operational device such as a keyboard, numeric keypad, touchscreen panel, etc., which allows a person in charge of the equipment to enter various information. The control device 26 is a host device of the abnormality detecting device 24, and is provided at a location remote from the abnormality detecting device 24 and the actuator 14. The control device 26 includes a communication unit 32. The communication unit 30 of the abnormality detecting device 24 and the communication unit 32 of the control device 26 are serially connected through fieldbus etc. The two communication units 30 and 32 thus send and receive various signals or information by serial communication. The communication unit 32 of the control device 26 can be connected via a network 34 to a plurality of PCs 36 (another device, external device) serving as host devices provided at remote locations.

The control device 26 supplies a control signal (control command) to solenoids 12*a*, 12*b* of the directional control valve 12 through the communication unit 32. The directional control valve 12 is responsive to the control signal supplied to the solenoids 12*a*, 12*b* to output a pressurized fluid, which is supplied from a fluid pressure source 38, selectively to the one end 16 or another end 20 of the actuator 14. That is, when the solenoid 12*a* is supplied with the control signal, the directional control valve 12 comes in the state illustrated by the upper one of the two blocks shown in FIG. 1. When the solenoid 12*b* is supplied with the control signal, the directional control valve 12 comes in the state illustrated by the lower block. A first tube 42 (first tube) is connected between the directional control valve 12 and a port 40 provided on the one end 16 side of the actuator 14, and a second tube 46 (second tube) is connected between the directional control valve 12 and a port 44 provided on another end 20 side of the actuator 14.

The actuator 14 is a fluid pressure cylinder in which a piston 50 (movable portion) coupled to a piston rod 48 is displaced along the left-right directions in FIG. 1 (displacement directions, stroke directions) on the basis of the supply of pressurized fluid from the directional control valve 12. The piston rod 48 extends from the piston 50 to the right in FIG. 1 and passes through another end 20 of the actuator 14 and projects out.

Now, when the solenoid 12*a* is excited by the supply of control signal to the solenoid 12*a* and the directional control valve 12 comes in the state of the upper block, then the pressurized fluid is supplied from the fluid pressure source 38 to the one end 16 through the directional control valve 12, the first tube 42, and the port 40, and the pressurized fluid in another end 20 is discharged outside from another end 20 through the port 44, the second tube 46, and the directional control valve 12. This causes the piston 50 and the piston rod 48 to move together to the right in FIG. 1 from the one end 16 to another end 20 of the actuator 14.

On the other hand, when the solenoid 12*b* is excited by the supply of control signal to the solenoid 12*b* and the directional control valve 12 comes in the state of the lower block, then the pressurized fluid is supplied from the fluid pressure source 38 to another end 20 through the directional control valve 12, the second tube 46, and the port 44, and the pressurized fluid in the one end 16 is discharged outside from the one end 16 through the port 40, the first tube 42, and the directional control valve 12. This causes the piston 50 and the piston rod 48 to move together to the left in FIG. 1 from another end 20 to the one end 16.

In this way, the control signal is supplied alternately from the control device 26 to the solenoids 12*a*, 12*b* through the communication unit 30, whereby the piston 50 and the piston rod 48 reciprocate between the one end 16 and another end 20 along the left-right directions of FIG. 1. Accordingly, in the embodiment, "stroke" means the distance the piston 50 travels from the one end 16 to another end 20 of the actuator 14 or from another end 20 to the one end 16 thereof. A silencer 52 is provided at the end of the discharge passage of the pressurized fluid flowing from the one end 16 or another end 20.

The first sensor 18 is provided on the one end 16 side of the actuator 14, and the second sensor 22 is provided on another end 20 side thereof. The first sensor 18 and the second sensor 22 are limit switches or magnetic switches that sense the piston 50 when the piston 50 has moved to positions facing the first sensor 18 and the second sensor 22, and output the results of sensing in the form of sense signals to the abnormality detecting device 24. When the piston 50 has moved away and the first sensor 18 and second sensor 22 do not face the piston 50 anymore, the first sensor 18 and the second sensor 22 stop outputting the sense signals.

Based on the results of sensing obtained by the first sensor 18 and the second sensor 22 and information inputted from outside through the operation and input unit 28, the abnormality detecting device 24 detects whether the actuator 14, the directional control valve 12, and the first tube 42 or the second tube 46 has any abnormality. The abnormality detecting device 24 sends information, e.g., the result of detection indicating presence of an abnormality, from the communication unit 30 to the communication unit 32 of the control device 26 through serial communication. The abnormality detecting device 24 can thus continuously perform the abnormality detecting processing for the actuator 14 etc. while the equipment is in operation.

<1.2. Internal Configuration of Abnormality Detecting Device 24>

Figure 2:
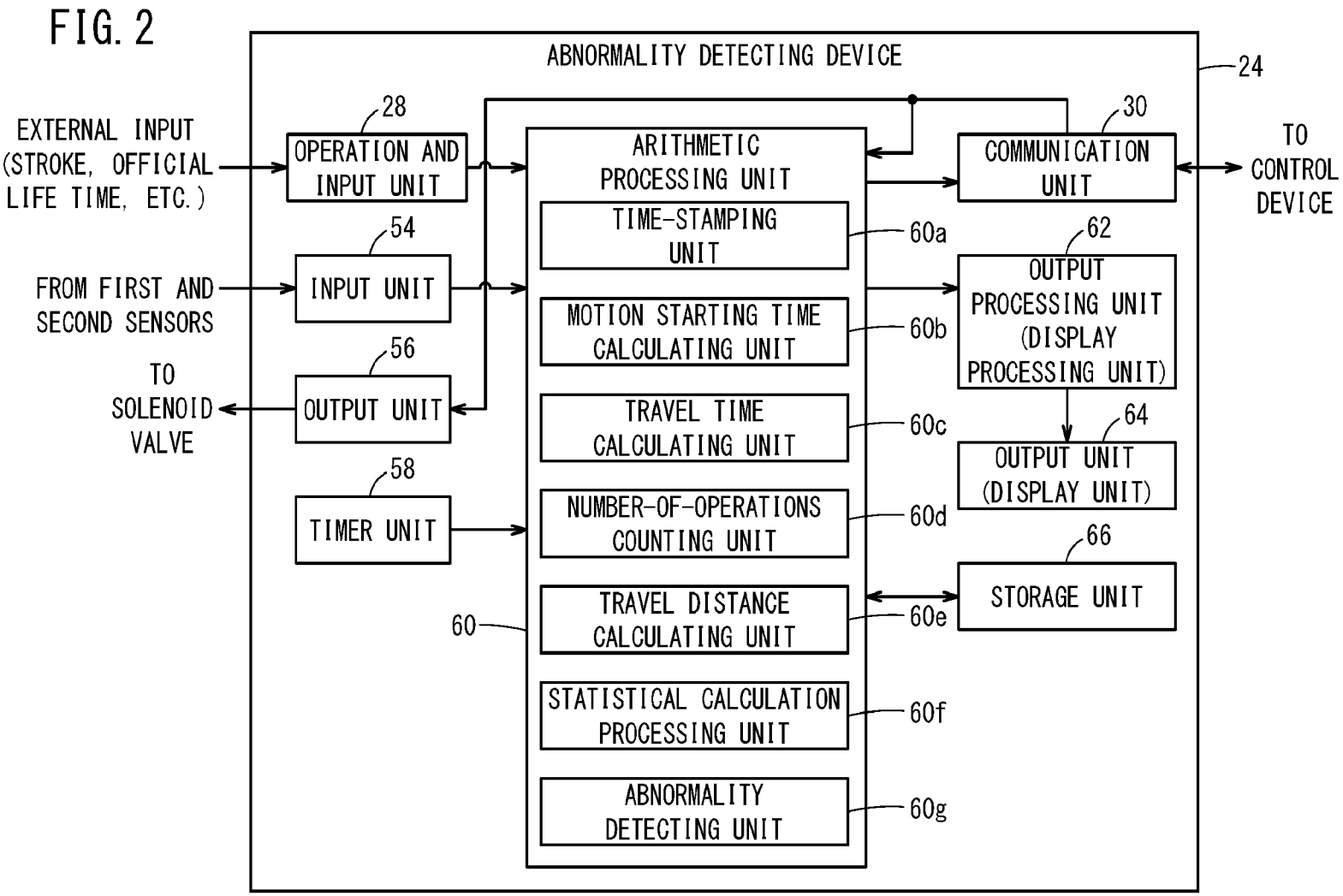
FIG. 2 is an internal configuration diagram of the abnormality detecting device of FIG. 1.

As shown in FIG. 2, the abnormality detecting device 24 includes the operation and input unit 28, an input unit 54, an output unit 56, a timer unit 58, an arithmetic processing unit 60, the communication unit 30, an output processing unit 62, an output unit 64, and a storage unit 66. The arithmetic processing unit 60 is a processor like a microcomputer etc. that executes a program stored in the storage unit 66 and performs the functions of a time-stamping unit 60*a*, a motion starting time calculating unit 60*b*, (motion starting time detecting unit), a travel time calculating unit 60*c*, a number-of-operations counting unit 60*d*, a travel distance calculating unit 60*e*, a statistical calculation processing unit 60*f*, and an abnormality detecting unit 60*g*.

A person in charge of the equipment operates the operation and input unit 28 and enters into the operation and input unit 28 the stroke of the piston 50, a time threshold of a travel time of the piston 50, an upper limit of the number of operations of the piston 50 (number-of-operations upper limit), a distance threshold of a total travel distance of the piston 50, an upper limit of a motion starting time of the piston 50 (time upper limit).

The travel time of the piston 50 means a time that the piston 50 requires to move from the one end 16 to another end 20 or from another end 20 to the one end 16. The time threshold is the upper limit value of an allowable range of the travel time of the piston 50.

The number of operations of the piston 50 means the number of reciprocations of the piston 50 between the one end 16 and another end 20 of the actuator 14, or the number of times that the piston 50 has moved from the one end 16 to another end 20 and from another end 20 to the one end 16 (twice the number of reciprocations). The number-of-operations upper limit means the upper limit value of an allowable range of the number of operations of the piston 50. The number-of-operations upper limit can be suitably changed according to the type (model) of the fluid pressure cylinder and the type (model) or the sealing method of the directional control valve 12.

The total travel distance of the piston 50 is the total distance the piston 50 has moved, is commensurate with the number of operations of the piston 50, and is the product of the number of operations and the stroke (the number of operations times the stroke equals the total travel distance). The distance threshold is the upper limit value of an allowable range of the total travel distance.

The motion starting time means a period of time measured, in one operation of the piston 50, from when the supply of the control signal to the solenoid 12*a*, 12*b* is started to when one of the first sensor 18 and the second sensor 22 becomes unable to sense the piston 50. The time upper limit is the upper limit value for an allowable range of the motion starting time.

The thresholds and upper limits explained above are values that depend on the official lifetime or guaranteed lifetime of the actuator 14, the directional control valve 12, the first tube 42, and second tube 46, etc. that is recommended by the manufacturer that produces the abnormality detecting system 10.

The input unit 54 detects a rising edge of the sense signal from the first sensor 18 or the second sensor 22 when the sense signal is inputted (when the level of the sense signal changes from a low level to a high level), and outputs the detected result (result of sensing) to the arithmetic processing unit 60. The input unit 54 also detects a falling edge of the sense signal when the input of the sense signal from the first sensor 18 or the second sensor 22 stops (when the level of the sense signal changes from the high level to the low level), and outputs the detected result (result of sensing) to the arithmetic processing unit 60.

The output unit 56 outputs the control signal, supplied from the control device 26 through the communication unit 30, to the solenoids 12*a*, 12*b* of the directional control valve 12. The timer unit 58 is a timer having a time counting function.

The time-stamping unit 60*a* of the arithmetic processing unit 60 performs time-stamping processing to provide time information concerning the present time to at least the results of sensing obtained by the first sensor 18 and the second sensor 22 when the results of sensing are inputted from the input unit 54.

The motion starting time calculating unit 60*b* calculates (detects), in each single operation of the piston 50, the motion starting time which is a period of time from when the supply of control signal to the solenoid 12*a*, 12*b* of the directional control valve 12 started to when one of the first and second sensors 18 and 22 becomes unable to sense the piston 50.

The travel time calculating unit 60*c* calculates the travel time of the piston 50 based on the results of sensing provided from the first sensor 18 and the second sensor 22. In this case, as the travel time, the travel time calculating unit 60*c* calculates, in a single operation of the piston 50, a period of time from when the supply of control signal starts to when the other of the first and second sensors 18 and 22 senses the piston 50.

The number-of-operations counting unit 60*d* counts the number of operations (actions) of the piston 50 based on the results of sensing provided from the first sensor 18 and the second sensor 22. In this case, in one operation of the piston 50, when a rising edge and a falling edge are inputted from the input unit 54 to the arithmetic processing unit 60, the number-of-operations counting unit 60*d* counts one (one operation of the piston 50).

The travel distance calculating unit 60*e* calculates the total travel distance of the piston 50 by multiplying the number of operations and the stroke of the piston 50 together.

The statistical calculation processing unit 60*f* performs statistical calculation processing to calculate statistical values such as mean values, variances and standard deviations, etc., for the motion starting time, travel time, number of operations, total travel distance, etc. In this case, the statistical calculation processing may be conducted, for example, using the statistical calculation processing method described in the patent publication cited earlier.

The abnormality detecting unit 60*g* detects presence/absence of an abnormality of the actuator 14, the directional control valve 12, and the first tube 42 or second tube 46, based on the motion starting time, travel time, number of operations or total travel distance, and the results of the statistical calculation processing, etc. A method for detecting presence/absence of an abnormality will be described later.

The storage unit 66 stores the results of various arithmetic processing from the arithmetic processing unit 60 and the results of sensing from the first sensor 18 and the second sensor 22 that have been timestamped by the time-stamping processing. The storage unit 66 thus stores the results of sensing and the results of arithmetic processing in association with the time information.

The output processing unit 62 performs processing corresponding to the output form of the output unit 64 when outputting through the output unit 64 the results of various arithmetic processing provided from the arithmetic processing unit 60 and the results of sensing provided from the first and second sensors 18 and 22 that have been timestamped. For example, if the output unit 64 is a display unit like a display device, the output processing unit 62 performs processing for displaying the results of sensing and the results of arithmetic processing on the display.

The communication unit 30 outputs the control signal supplied from the communication unit 32 of the control device 26 to the output unit 56 and the arithmetic processing unit 60. The communication unit 30 also sends to the communication unit 32 of the control device 26 the results of various arithmetic processing by the arithmetic processing unit 60 and the results of sensing by the first and second sensors 18 and 22 that have been timestamped.

2. Operations of Embodiment

Operations of the abnormality detecting system 10 (abnormality detecting method) of the embodiment constructed as described above will be explained referring to the flowchart of FIGS. 3 and 4. Here a case is explained where the supply of control signal from the control device 26 (see FIG. 1) to the solenoid 12*a* is started, whereby the actuator 14 is activated, and the piston 50 first moves from the one end 16 to another end 20 of the actuator 14. The control device 26 supplies the control signal alternately to the two solenoids 12*a*, 12*b*.

Figure 3:
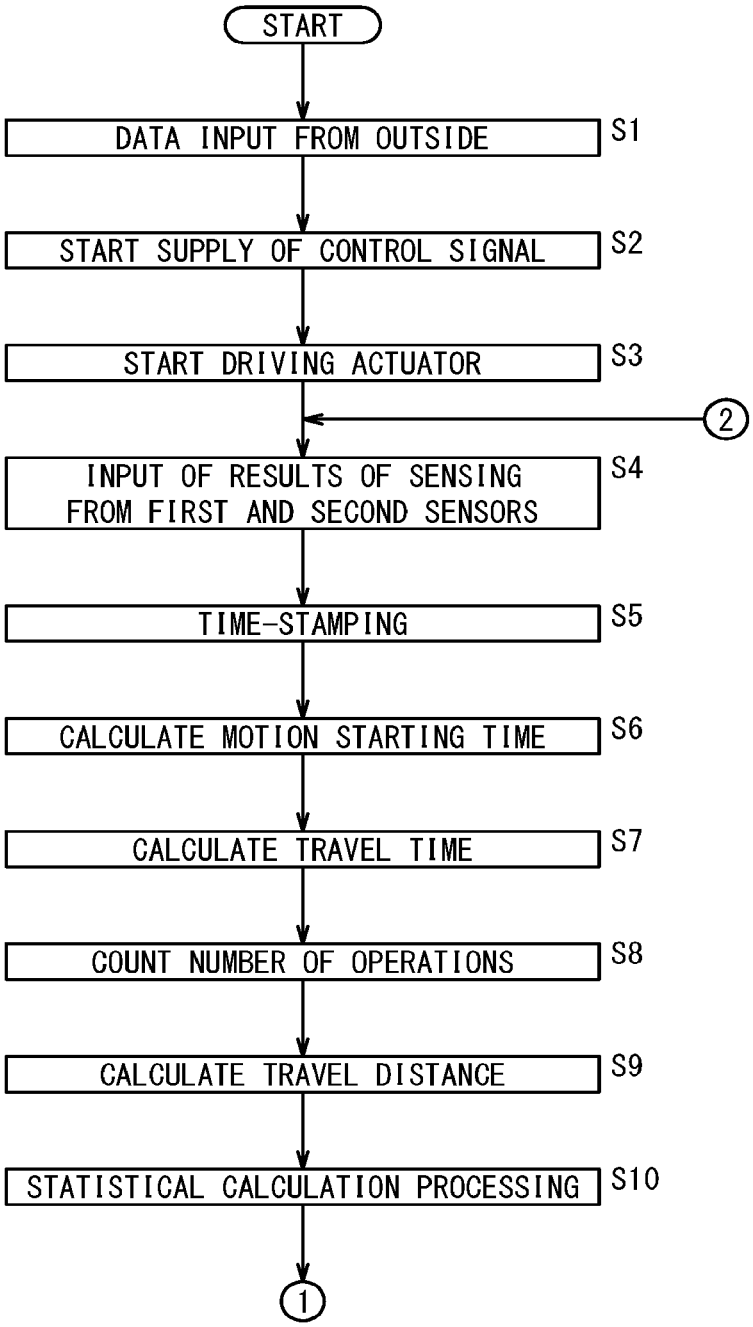
FIG. 3 is a flowchart of a process (abnormality detecting method) performed by the abnormality detecting system of FIG. 1.

First, at step S1 (first step) of FIG. 3, a person in charge of the equipment operates the operation and input unit 28 (see FIGS. 1 and 2) to input the stroke of the piston 50, the time threshold, the number-of-operations upper limit, the distance threshold, and the time upper limit. The inputted settings are stored in the storage unit 66.

At step S2, the control device 26 starts the supply of control signal to the communication unit 30 of the abnormality detecting device 24 through the communication unit 32. The communication unit 30 of the abnormality detecting device 24 outputs the supplied control signal to the output unit 56 and the arithmetic processing unit 60. This allows the arithmetic processing unit 60 to recognize that the supply of control signal has started. The output unit 56 supplies the control signal to the solenoid 12*a* of the directional control valve 12.

At step S3, as the supply of control signal to the solenoid 12*a* excites the solenoid 12*a*, the pressurized fluid is supplied from the fluid pressure source 38 to the one end 16 of the actuator 14 through the directional control valve 12, the first tube 42, and the port 40, and the pressurized fluid in another end 20 is discharged outside from another end 20 through the port 44, the second tube 46, and the directional control valve 12. As a result, the piston 50 and piston rod 48 move from the one end 16 to another end 20 of the actuator 14.

Then, due to the displacement of the piston 50 to another end 20, the first sensor 18 becomes unable to sense the piston 50 at the next step S4 (second step). On the other hand, the second sensor 22 can sense the piston 50 after the piston 50 has moved to another end 20. The results of sensing obtained by the first sensor 18 and the second sensor 22 are inputted to the input unit 54. The input unit 54 detects the falling edge of the sense signal from the first sensor 18 and outputs the result of detection (result of sensing) to the arithmetic processing unit 60. The input unit 54 also detects the rising edge of the sense signal from the second sensor 22 and outputs the result of detection (result of sensing) to the arithmetic processing unit 60.

At step S5, the time-stamping unit 60*a* of the arithmetic processing unit 60 executes time-stamping processing that provides present time information to the results of sensing provided from the first sensor 18 and the second sensor 22, i.e., to the rising edge and the falling edge. The time-stamping unit 60*a* stores into the storage unit 66 the results of sensing from the first sensor 18 and the second sensor 22 (information on the rising edge and the falling edge) that are associated with the time information.

At step S6, the motion starting time calculating unit 60*b* calculates the motion starting time, a period of time from when the supply of control signal to the solenoid 12*a* starts to when the first sensor 18 becomes unable to sense the piston 50, and stores the calculated motion starting time into the storage unit 66.

At step S7 (third step), based on the motion starting time and the rising edge, the travel time calculating unit 60*c* calculates the travel time, a period of time from when the supply of control signal to the solenoid 12*a* starts to when the second sensor 22 senses the piston 50, and stores the calculated travel time into the storage unit 66.

At step S8, based on the falling edge and the rising edge, the number-of-operations counting unit 60*d* counts one action of the piston 50, and stores the counted number of actions into the storage unit 66.

At step S9 (fourth step), the travel distance calculating unit 60*e* multiplies together the number of operations counted by the number-of-operations counting unit 60*d* and the stroke stored in the storage unit 66, to thereby calculate the total travel distance of the piston 50, and stores the calculated total travel distance into the storage unit 66.

At step S10, the statistical calculation processing unit 60*f* calculates statistical values, such as mean values, variances, and standard deviations, etc., for the motion starting time, travel time, number of operations, and total travel distance.

In this way, through the operations at steps S5 to S10, the storage unit 66 has stored the results of sensing obtained by the first sensor 18 and the second sensor 22, the motion starting time, the travel time, the number of operations, the total travel distance, and the statistical values, in association with the time information.

Figure 4:
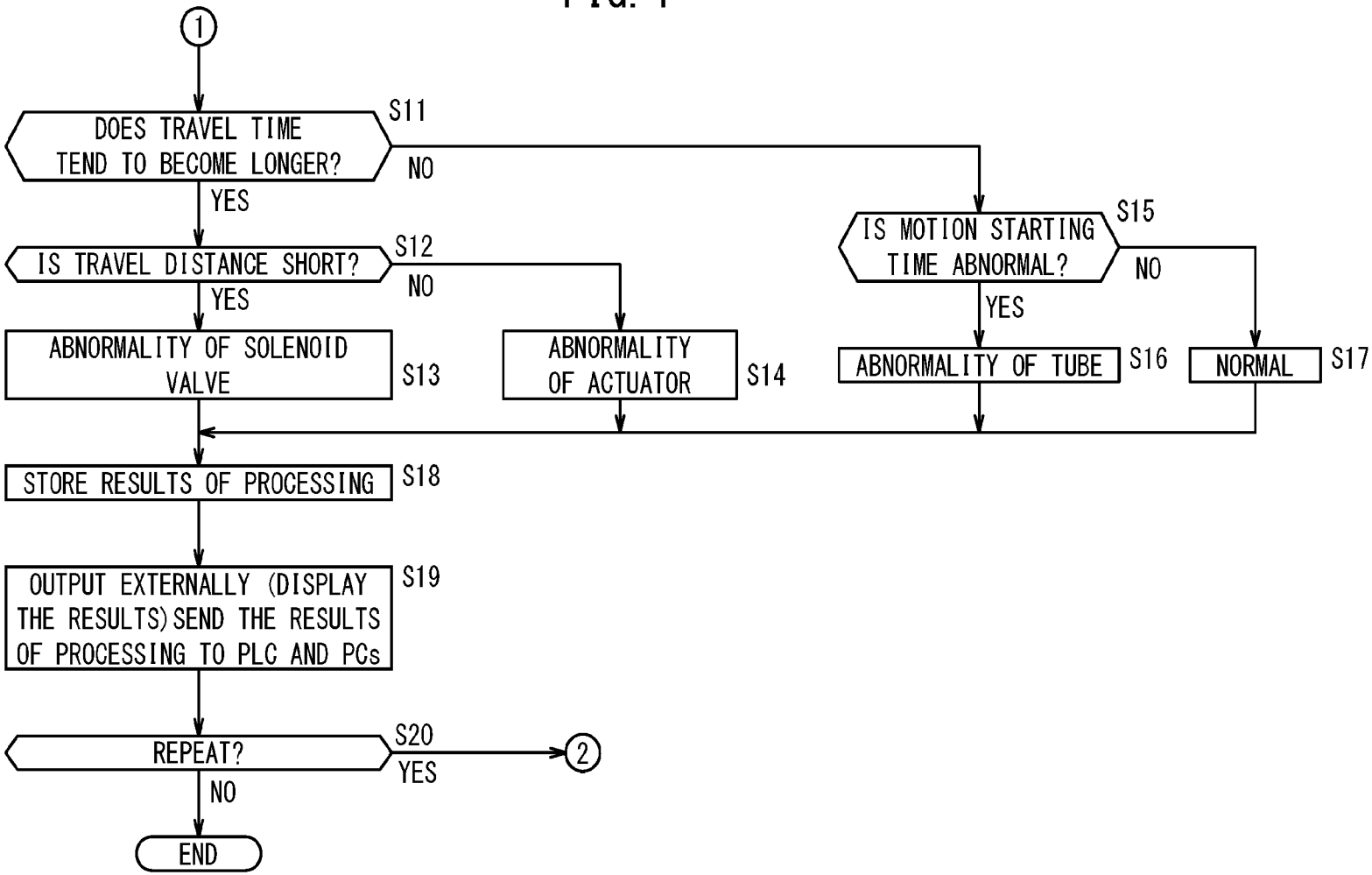
FIG. 4 is a flowchart of the process (abnormality detecting method) performed by the abnormality detecting system of FIG. 1.

Then, at steps S11 to S17 of FIG. 4 (fifth step), the abnormality detecting unit 60*g* (see FIG. 2) detects whether the actuator 14 (see FIG. 1), the directional control valve 12, and the first tube 42 or second tube 46 has abnormalities, based on the calculated results and the settings previously set in the storage unit 66.

That is, at step S11, the abnormality detecting unit 60*g* determines whether the travel time of the piston 50 tends to become longer, i.e., whether or not the travel time is equal to or longer than the time threshold.

If the travel time is equal to or longer than the time threshold (step S11: YES), then at the next step S12, the abnormality detecting unit 60*g* determines whether the total travel distance of the piston 50 is shorter, i.e., whether the number of operations is less than the number-of-operations upper limit, or whether the total travel distance is less than the distance threshold.

If the number of operations is less than the number-of-operations upper limit, or if the total travel distance is less than the distance threshold (step S12: YES), then, since both steps S11 and S12 have shown affirmative results, the abnormality detecting unit 60*g* determines at the next step S13 that the directional control valve 12 is suffering an abnormality such as a fault.

If the number of operations is equal to or larger than the number-of-operations upper limit and the total travel distance is equal to or longer than the distance threshold (step S12: NO), then at step S14, the abnormality detecting unit 60*g* determines that the actuator 14 is suffering an abnormality such as a fault.

On the other hand, at step S11, if the travel time is less than the time threshold (step S11: NO), the abnormality detecting unit 60*g* determines at step S15 whether the motion starting time of the piston 50 is abnormal, i.e., whether or not the motion starting time is equal to or longer than the time upper limit.

If the motion starting time is equal to or longer than the time upper limit (step S15: YES), then the abnormality detecting unit 60*g* determines at step S16 that the first tube 42 or second tube 46 is suffering an abnormality such as a fault.

If the motion starting time is less than the time upper limit (step S15: NO), then the abnormality detecting unit 60*g* determines at step S17 that the actuator 14, the directional control valve 12, and the first tube 42 or second tube 46 has no abnormality like a fault, i.e., they are normal.

As a result, at step S18, the abnormality detecting unit 60*g* stores into the storage unit 66 the results of determination concerning the presence/absence of abnormality that have been made at any of steps S13, S14, S16, and S17.

At step S19, the output processing unit 62 performs processing corresponding to the output form of the output unit 64, with the time information, the results of sensing obtained by the first sensor 18 and the second sensor 22, the results of operational processing obtained by the arithmetic processing unit 60, and the results of determination made by the abnormality detecting unit 60*g* that have been stored in the storage unit 66. Thus, the output unit 64 can outwardly report the results processed by the output processing unit 62. For example, if the output unit 64 is a display unit, the screen of the display unit displays the time information, the results of sensing by the first sensor 18 and the second sensor 22, the results of operational processing by the arithmetic processing unit 60, the results of determination by the abnormality detecting unit 60*g*, and the like. Further, the communication unit 30 sends the time information and the respective results to the communication unit 32 of the control device 26 through serial communication. The communication unit 32 of the control device 26 sends the received information further to the PCs 36 at remote locations through the network 34.

At step S20, the arithmetic processing unit 60 determines whether to repeat steps S4 to S19. As described above, the control device 26 supplies the control signal alternately to the solenoids 12*a*, 12*b*. Hence, if step S20 provides an affirmative determination, the process returns to step S4 to repeat steps S4 to S19, thereby performing the abnormality detecting process for detecting abnormalities that could occur when the piston 50 moves from another end 20 to the one end 16. In this way, by repeatedly performing steps S4 to S19, the embodiment can detect presence/absence of abnormality of the actuator 14, the directional control valve 12, and the first tube 42 or second tube 46, even while the piston 50 is reciprocating along the displacement directions (while the actuator 14 is being driven).

If some abnormality has been detected according to the results of determination made at steps S13, S14, S16 and so the actuator 14 is made to stop moving in order to deal with the abnormality (step S20: NO), then the supply of control signal from the control device 26 is stopped. The supply of control signal from the control device 26 is stopped also when the actuator 14 is made to stop moving due to some reason like regular maintenance work etc. (step S20: NO).

3. Modifications

The description above has illustrated an example in which the operation and input unit 28 and the output unit 64 are contained in the abnormality detecting device 24. In an embodiment, the operation and input unit 28 and the output unit 64 may be provided as external units outside of the abnormality detecting device 24.

The description above has illustrated an example in which the control device 26 and the PCs 36 are connected through the network 34. In an embodiment, the control device 26 and the PCs 36 may be connected in any manner as long as they can be communicably connected to each other.

Further, the description above has illustrated an example in which the various information stored in the storage unit 66 is sent from the communication unit 30 to the control device 26 and the PCs 36. In an embodiment, since the various information is stored in the storage unit 66 in association with the time information, the various information may be stored in a portable storage unit 66 (storage device) such as a USB memory etc. so as to allow the control device 26 or the PCs 36 to acquire the various information at some later time by removing the storage device from the abnormality detecting device 24 and connecting it to the control device 26 or the PCs 36.

4. Effects of Embodiments

As described above, the abnormality detecting system 10 and the abnormality detecting method according to the embodiment detects an abnormality of the actuator 14 based on the travel time of the piston 50 (movable portion) that is displaced between one end 16 and another end 20 of the actuator 14.

The abnormality detecting system 10 includes: the first sensor 18 (first sensor) that senses the piston 50 that has been displaced to the one end 16; the second sensor 22 (second sensor) that senses the piston 50 that has been displaced to another end 20; the operation and input unit 28 (external input unit) that inputs the stroke of the piston 50; the travel time calculating unit 60*c* that calculates the travel time based on the results of sensing obtained by the first sensor 18 and the second sensor 22; the travel distance calculating unit 60*e* that calculates a total travel distance of the piston 50 based on the number of operations and the stroke of the piston 50; and the abnormality detecting unit 60*g* that detects an abnormality of at least the actuator 14 based on the travel time and either the number of operations or the total travel distance.

The abnormality detecting method includes: the step S1 (first step) of inputting the stroke of the piston 50 by means of the operation and input unit 28; the step S4 (second step) of sensing by means of the first sensor 18 the piston 50 that has been displaced to the one end 16, and sensing by means of the second sensor 22 the piston 50 that has been displaced to another end 20; the step S7 (third step) of calculating, by means of the travel time calculating unit 60*c*, the travel time based on the results of sensing obtained by the first sensor 18 and the second sensor 22; the step S9 (fourth step) of calculating, by means of the travel distance calculating unit 60*e*, a total travel distance of the piston 50 based on the number of operations and the stroke of the piston 50; and the steps S11 to S17 (fifth step) of detecting, by means of the abnormality detecting unit 60*g*, an abnormality of at least the actuator 14 based on the travel time and either the number of operations or the total travel distance.

Thus, the stroke of the piston 50 is entered as input from outside and an abnormality of the actuator 14 is detected on the basis of the input stroke, the results of sensing obtained by the first sensor 18 and the second sensor 22, and the number of operations of the piston 50. Accordingly, it is possible to detect an abnormality of the actuator 14 more easily, at lower cost, more accurately, and more speedily, as compared to the technique of the patent publication cited earlier, which detects an abnormality of the actuator using statistical data stored in the device.

Furthermore, because the abnormality detecting system 10 can detect an abnormality of at least the actuator 14 simply and accurately, it is possible to improve maintainability of the equipment when maintenance work is performed regularly (according to a plan).

Moreover, because the abnormality detecting system 10 receives the stroke of the piston 50 entered through the operation and input unit 28, it is also possible to set the stroke taking account of a factor of safety up to replacement of the actuator 14.

The abnormality detecting system 10 further includes the directional control valve 12 that supplies a pressurized fluid selectively to the one end 16 or another end 20 based on a control signal supplied from outside. The piston 50 is displaced between the one end 16 and another end 20 by the selective supply of the pressurized fluid to the one 16 end or another end 20. The operation and input unit 28 inputs the stroke, a time threshold of the travel time, and a number-of-operations upper limit of the number of operations or a distance threshold of the total travel distance. The travel distance calculating unit 60*e* is configured to calculate the total travel distance by multiplying the number of operations and the stroke together.

Then, the abnormality detecting unit 60*g* detects an abnormality of the directional control valve 12 if the travel time is equal to or longer than the time threshold, and the number of operations is less than the number-of-operations upper limit or the total travel distance is less than the distance threshold. Further, the abnormality detecting unit 60*g* detects an abnormality of the actuator 14 if the travel time is equal to or longer than the time threshold and the number of operations is equal to or larger than the number-of-operations upper limit or the total travel distance is equal to or longer than the distance threshold.

Thus, the abnormality detecting system 10 can easily and accurately narrow down the cause of the abnormality such as a fault based on the two parameters of the travel time and the total travel distance, making it possible to detect the abnormality efficiently.

The abnormality detecting system 10 further includes: the first tube 42 (first tube) that supplies the pressurized fluid from the directional control valve 12 to the one end 16; the second tube 46 (second tube) that supplies the pressurized fluid from the directional control valve 12 to another end 20; and the motion starting time calculating unit 60*b* (motion starting time detecting unit) that detects, for each single operation of the piston 50, a motion starting time of the piston 50 that is the time from when the supply of the control signal to the directional control valve 12 is started to when one of the first sensor 18 and the second sensor 22 becomes unable to sense the piston 50.

In this case, the operation and input unit 28 inputs a time upper limit of the motion starting time, and the abnormality detecting unit 60*g* detects an abnormality of the first tube 42 or the second tube 46 if the motion starting time is equal to or longer than the time upper limit.

It is thus possible to easily and efficiently detect an abnormality of the first tube 42 or the second tube 46. Further, it is possible to specify which of the actuator 14, the directional control valve 12, and the first tube 42 or second tube 46 is the cause of the abnormality, and therefore appropriate and quick measures can be taken for the device causing the abnormality.

The abnormality detecting system 10 further includes the abnormality detecting device 24 including the operation and input unit 28, the travel time calculating unit 60*c*, the travel distance calculating unit 60*e*, the abnormality detecting unit 60*g*, and the time-stamping unit 60*a* configured to provide present time information to at least the results of sensing obtained by the first sensor 18 and the second sensor 22 when the results of sensing are inputted.

Utilizing the concept of time-stamping makes it possible to manage the presence/absence of an abnormality even at a location remote from the actuator 14.

In this case, the abnormality detecting device 24 further includes the communication unit 30 configured to perform communications with the control device 26 (another device). The communication unit 30 sends to the control device 26 the results of sensing provided with the time information and the result of detection obtained by the abnormality detecting unit 60*g*.

It is thus possible to easily manage the presence/absence of an abnormality at the control device 26 located at a place remote from the actuator 14. Further, the control device 26 can give instructions to the abnormality detecting device 24 so that the abnormality can suitably be dealt with.

The another device includes the control device 26 that performs serial communication with the communication unit 30 and the PCs 36 (external device) that are connected to the control device 26 through the network 34. In this case, the control device 26 supplies the control signal to the directional control valve 12 through the communication unit 30 by the serial communication, and the control device 26 receives the time information, the results of sensing, and the result of detection from the communication unit 30 and sends the time information, the results of sensing, and the result of detection further to the PCs 36 through the network 34.

It is thus possible also in this case to easily manage the presence/absence of an abnormality at the PCs 36 at remote locations. Further, if a PC 36 centrally supervises a plurality of actuators 14 and abnormality detecting devices 24, the PC 36 can give appropriate instructions about an abnormality individually to the abnormality detecting device 24 that has detected the abnormality.

The abnormality detecting device 24 further includes the output unit 64 configured to outwardly output at least the result of detection obtained by the abnormality detecting unit 60*g*. This allows a person in charge of the equipment etc. to be informed of the presence/absence of an abnormality.

In this case, if the output unit 64 is a display unit that displays the result of detection, the screen of the display unit displays the presence/absence of an abnormality so that the person in charge etc. can be informed more easily.

The present invention is not limited to the embodiments described above but can of course adopt various configurations based on the details described in the specification.

What is claimed is:

1. An abnormality detecting system configured to detect an abnormality of an actuator based on a travel time of a movable portion that is displaced between one end and another end of the actuator, the system comprising:

a first sensor;

a second sensor;

an external input unit;

a travel time calculating unit;

a travel distance calculating unit;

an abnormality detecting unit; and a directional control valve, wherein:

the first sensor senses the movable portion that has been displaced to the one end, the second sensor senses the movable portion that has been displaced to the another end, the external input unit inputs a stroke of the movable portion, the travel time calculating unit calculates the travel time based on results of sensing obtained by the first sensor and the second sensor, the travel distance calculating unit calculates a total travel distance of the movable portion based on number of operations of the movable portion and the stroke, the abnormality detecting unit detects an abnormality of at least the actuator based on the travel time and either the number of operations or the total travel distance, the directional control valve supplies a pressurized fluid selectively to the one end or the another end based on a control signal supplied from outside, the movable portion is a piston that is displaced between the one end and the another end by the selective supply of the pressurized fluid to the one end or the another end, the external input unit inputs the stroke, a time threshold of the travel time, and either a number-of-operations upper limit for the number of operations or a distance threshold of the total travel distance, the travel distance calculating unit is configured to calculate the total travel distance by multiplying the number of operations and the stroke together, and the abnormality detecting unit is configured to:

detect an abnormality of the directional control valve when the travel time is equal to or longer than the time threshold, and either when the number of operations is less than the number-of-operations upper limit or when the total travel distance is less than the distance threshold, and detect an abnormality of the actuator when the travel time is equal to or longer than the time threshold, and either when the number of operations is equal to or larger than the number-of-operations upper limit or when the total travel distance is equal to or longer than the distance threshold.

2. The abnormality detecting system according to claim 1, further comprising:

a first tube;

a second tube; and a motion starting time detecting unit, wherein:

the first tube supplies the pressurized fluid from the directional control valve to the one end, the second tube supplies the pressurized fluid from the directional control valve to the another end, the motion starting time detecting unit detects, for each single operation of the movable portion, a motion starting time of the movable portion that is a time from when supply of the control signal to the directional control valve is started to when one of the first sensor and the second sensor becomes unable to sense the movable portion, the external input unit inputs a time upper limit for the motion starting time, and the abnormality detecting unit is configured to detect an abnormality of the first tube or the second tube when the motion starting time is equal to or longer than the time upper limit.

3. The abnormality detecting system according to claim 1, further comprising an abnormality detecting device that includes:

the external input unit, the travel time calculating unit, the travel distance calculating unit, the abnormality detecting unit, and a time-stamping unit, wherein the time-stamping unit provides time information that is a present time to at least the results of sensing obtained by the first sensor and the second sensor when the results of sensing are inputted.

4. The abnormality detecting system according to claim 3, wherein the abnormality detecting device further comprises a communication unit, and the communication unit sends to another device the results of sensing provided with the time information and a result of detection obtained by the abnormality detecting unit.

5. The abnormality detecting system according to claim 4, wherein the another device comprises a control device, an external device, wherein the control device supplies the control signal to the directional control valve through the communication unit by serial communication, and the control device receives the time information, the results of sensing, and the result of detection from the communication unit and sends the time information, the results of sensing, and the result of detection to the external device through a network.

6. The abnormality detecting system according to claim 3, wherein the abnormality detecting device further includes an output unit, and wherein the output unit outwardly outputs at least a result of detection obtained by the abnormality detecting unit.

7. The abnormality detecting system according to claim 6, wherein the output unit is a display unit that displays the result of detection.

8. An abnormality detecting method for detecting an abnormality of an actuator based on a travel time of a movable portion that is displaced between one end and another end of the actuator, the method comprising:

a first step of inputting a stroke of the movable portion by means of an external input unit;

a second step of sensing by means of a first sensor the movable portion that has been displaced to the one end, and sensing by means of a second sensor the movable portion that has been displaced to the another end;

a third step of calculating, by means of a travel time calculating unit, the travel time based on results of sensing obtained by the first sensor and the second sensor;

a fourth step of calculating, by means of a travel distance calculating unit, a total travel distance of the movable portion based on a number of operations and the stroke of the movable portion; and a fifth step of detecting, by means of an abnormality detecting unit, an abnormality of at least the actuator based on the travel time and either the number of operations or the total travel distance, wherein a directional control valve supplies a pressurized fluid selectively to the one end or the another end based on a control signal supplied from outside to the directional control valve, the movable portion is a piston that is displaced between the one end and the another end by the selective supply of the pressurized fluid to the one end or the another end, in the first step, the external input unit inputs the stroke, a time threshold of the travel time, and either a number-of-operations upper limit for the number of operations or a distance threshold of the total travel distance, in the fourth step, the travel distance calculating unit calculates the total travel distance by multiplying the number of operations and the stroke together, and in the fifth step, the abnormality detecting unit:

detects an abnormality of the directional control valve when the travel time is equal to or longer than the time threshold, and either when the number of operations is less than the number-of-operations upper limit or when the total travel distance is less than the distance threshold, and detects an abnormality of the actuator when the travel time is equal to or longer than the time threshold, and either the number of operations is equal to or larger than the number-of-operations upper limit or when the total travel distance is equal to or longer than the distance threshold.

* * * * *